US008539629B2

(12) United States Patent
Han

(10) Patent No.: US 8,539,629 B2
(45) Date of Patent: Sep. 24, 2013

(54) FIT-TOGETHER TYPE OF PRECAST CONCRETE LINING AND BRIDGING STRUCTURAL BODY

(75) Inventor: Manyop Han, Yongin-si (KR)

(73) Assignee: Supportec Co., Ltd., Seoul (KR)

( * ) Notice: Subject to any disclaimer, the term of this patent is extended or adjusted under 35 U.S.C. 154(b) by 0 days.

(21) Appl. No.: 12/918,044

(22) PCT Filed: Feb. 18, 2009

(86) PCT No.: PCT/KR2009/000780
§ 371 (c)(1),
(2), (4) Date: Aug. 17, 2010

(87) PCT Pub. No.: WO2009/104904
PCT Pub. Date: Aug. 27, 2009

(65) Prior Publication Data

US 2010/0307081 A1 Dec. 9, 2010

(30) Foreign Application Priority Data

Feb. 18, 2008 (KR) ..... 10-2008-0014354

(51) Int. Cl.
*E01D 2/04* (2006.01)

(52) U.S. Cl.
USPC ..... 14/74.5; 14/73; 52/223.1

(58) Field of Classification Search
USPC ..... 14/73, 74.5; 404/34–36; 52/223.1
See application file for complete search history.

(56) References Cited

U.S. PATENT DOCUMENTS

| | | | | | |
|---|---|---|---|---|---|
| 2,716,373 | A | * | 8/1955 | Chollar et al. | 404/50 |
| 3,484,999 | A | * | 12/1969 | Van Der | 52/79.7 |
| 3,707,819 | A | * | 1/1973 | Calhoun et al. | 52/319 |
| 3,722,159 | A | * | 3/1973 | Kessler | 52/252 |
| 3,879,914 | A | * | 4/1975 | Haller et al. | 52/745.13 |
| 4,646,495 | A | * | 3/1987 | Chalik | 52/236.8 |
| 4,972,537 | A | * | 11/1990 | Slaw, Sr. | 14/77.1 |
| 5,457,840 | A | * | 10/1995 | Derechin | 14/73 |

(Continued)

FOREIGN PATENT DOCUMENTS

| | | |
|---|---|---|
| JP | 08128006 | 5/1996 |
| JP | 2001248104 | 9/2001 |

(Continued)

OTHER PUBLICATIONS

ISA Korea, International Search Report of PCT/KR2009/000780, Sep. 22, 2009, 3 pages.

(Continued)

*Primary Examiner* — Raymond W Addie
(74) *Attorney, Agent, or Firm* — Alleman Hall McCoy Russell & Tuttle LLP

(57) ABSTRACT

The present invention relates to a fit-together type of precast concrete lining and bridging structural body in which main girders are integrated with deck plates. Precast concrete deck members connected in longitudinal and transverse directions are pre-stressed by pre-stressed members, thereby making it possible to increase load carrying capacity or rigidity of a structure to stably use the structure for a long time. Further, it is possible to support the load applied from the top of a deck structure with a small thickness, and to make the deck structure light. Due to a knockdown type (fit-together type), installation and dismantlement are easy, and reuse is possible, and thus it is possible to provide convenient construction and low production costs.

7 Claims, 24 Drawing Sheets

(56) References Cited

U.S. PATENT DOCUMENTS

| | | | | |
|---|---|---|---|---|
| 5,617,599 | A * | 4/1997 | Smith | 14/73 |
| 5,634,308 | A * | 6/1997 | Doolan | 52/334 |
| 5,771,518 | A * | 6/1998 | Roberts | 14/73.1 |
| 5,826,290 | A * | 10/1998 | Kokonis | 14/73.1 |
| 6,065,257 | A * | 5/2000 | Nacey et al. | 52/223.8 |
| 6,381,793 | B2 * | 5/2002 | Doyle et al. | 14/73 |
| 6,470,524 | B1 * | 10/2002 | Mairantz | 14/77.1 |
| 6,588,160 | B1 | 7/2003 | Grossman | |
| 6,668,412 | B1 * | 12/2003 | Tadros et al. | 14/73.1 |
| 6,875,156 | B1 * | 4/2005 | Steiger | 477/158 |
| 7,162,838 | B2 * | 1/2007 | Ardern | 52/127.9 |
| 7,296,317 | B2 * | 11/2007 | Grace | 14/73 |
| 7,475,446 | B1 * | 1/2009 | He | 14/77.1 |
| 7,600,283 | B2 * | 10/2009 | Nelson | 14/77.1 |
| 2006/0117504 | A1 * | 6/2006 | Ronald et al. | 14/73 |
| 2009/0064610 | A1 * | 3/2009 | Ahn | 52/223.11 |

FOREIGN PATENT DOCUMENTS

| | | | |
|---|---|---|---|
| JP | 2002138561 | | 5/2002 |
| JP | 2004-027504 | A | 1/2004 |
| JP | 2006-283317 | A | 10/2006 |
| KR | 20-0351464 | Y1 | 5/2004 |
| KR | 20-0420900 | Y1 | 7/2006 |

OTHER PUBLICATIONS

State Intellectual Property Office of P.R. China, Notification of First Office Action of CN200980105578.0, Jun. 5, 2012, 8 pages.

* cited by examiner

FIT-TOGETHER TYPE OF PRECAST CONCRETE LINING AND BRIDGING STRUCTURAL BODY

CROSS-REFERENCE TO RELATED APPLICATIONS

This is the U.S. National Phase of International PCT Application Serial No. PCT/KR2009/000780 for FIT-TOGETHER TYPE OF PRECAST CONCRETE LINING AND BRIDGING STRUCTURAL BODY, filed Feb. 18, 2009, which claims priority to Korean Patent Application No. 10-2008-0014354 for PRECAST CONCRETE DECK STRUCTURE, filed on Feb. 18, 2008, both of which are hereby incorporated by reference in their entirety for all purposes.

TECHNICAL FIELD

The present invention relates to a fit-together type of precast concrete lining and bridging structural body. More particularly, the present invention is directed to mounting prestressed members on concrete deck members interconnected in longitudinal and transverse directions so as to reinforce rigidity.

BACKGROUND ART

In general, deck structures are temporarily installed within or around a construction site for the purpose of maintaining a road, removing soil, and securing a work space for construction when underground structures or bridges are constructed.

When typical underground structures are constructed, vertical piles are installed before excavation construction, and then main girders and deck plates are installed while the ground is being partially excavated. When the deck plates are completely installed, the excavation and installation of struts depending on the excavation are repeated. In this way, the construction is carried out.

Further, in the case of temporary bridges, a plurality of pier beams are driven into the ground one by one at predetermined intervals, and stiffening members are interconnected and reinforced between the pier beams. Thereby, a lower support structure is installed. Main girders are installed on top of the installed lower support structure, and deck plates are installed on top of the main girders.

These deck structures are mostly formed of steel, and are configured to be able to construct a temporary road in such a manner that upper plate members are placed on a plurality of support members made of steel.

Further, these deck structures have sufficient strength so that each member can withstand the load of a vehicle, and have uneven surfaces to increase a frictional force.

However, most of the deck structures formed of steel are vulnerable to moisture, salt, calcium chloride, and acidic substances, and thus are easily corroded.

Further, the deck structures have short durability, and are difficult to use with snow-removal chemicals such as calcium chloride when snow accumulates in the winter. As such, safety management becomes an issue.

Particularly, the steel deck structures formed of steel not only require an excessive cost of production, but also suffer from much noise and vibration due to frequent traffic. Also, it is difficult to check levels of wear and corrosion of the bottoms of the steel deck structures, and thus to replace the steel deck structures.

To solve these problems, a complex deck plate in which concrete is poured between and integrated with section steels has been proposed in Korean Patent Laid Open publication No. 2004-0069886, titled "Concrete Reinforcement Section Steel Plate," and Korean Utility Model Registration No. 0351464, titled "Bridge Deck."

In Korean Patent Laid Open publication No. 2007-0070565, titled "Deck Plate Structure" and filed by the applicant of this application, an improved deck plate structure has been proposed, which is capable of being made of concrete, reducing dead weight, and enabling easy disassembly from and assembly to a main girder in a simple screwing mode.

DISCLOSURE

Technical Problem

However, conventional deck structures formed of a concrete material are designed to have a predetermined thickness so as to withstand the load applied from the top, and thus have heavy dead weight as well as difficulty in joining with main girders.

Further, due to the load applied from an upper portion to a lower portion, the deck plates are subjected to a compressive force at the upper portion, and a tensile force on the lower portion. In the case of the concrete material, rigidity against the compressive force is high, but rigidity against the tensile force is greatly lower than the rigidity against the compressive force. For this reason, the deck plates are easily damaged during construction.

Accordingly, the present invention has been made in an effort to provide a fit-together type of precast concrete lining and bridging structural body in which a deck structure, which integrates main girders with deck plates and is formed of a concrete material, is pre-stressed, thereby making it possible to increase rigidity against a tensile force and to reduce dead weight.

Technical Solution

This problem is solved by providing a fit-together type of precast concrete lining and bridging structural body which is assembled with a plurality of precast concrete deck members formed of a concrete material in an arbitrary shape to be connectable in longitudinal and transverse directions.

Further, such a problem is solved by providing a fit-together type of precast concrete lining and bridging structural body in which opposite ends of pre-stressed members generating pre-stress are fixed to the precast concrete deck members connected in numbers.

Advantageous Effects

According to the exemplary embodiments of the invention, precast concrete deck members connected in longitudinal and transverse directions are pre-stressed by pre-stressed members, thereby making it possible to increase load carrying capacity and rigidity against a tensile force to ensure stable use for a long time.

Further, it is possible to support the load applied from the top of a deck structure having a small thickness, and thus to make the deck structure light. Due to the knockdown type (fit-together type), installation and dismantlement are easy, and reuse is possible, and thus it is possible to provide convenient construction and low production costs.

MODE FOR INVENTION

Hereinafter, exemplary embodiments of the present invention will be described in detail with reference to the accompanying drawings.

FIGS. 1 to 4 are exploded perspective views illustrating an exemplary embodiment of the present invention, and illustrate various examples of a box-shaped precast concrete deck member.

Figure 5:
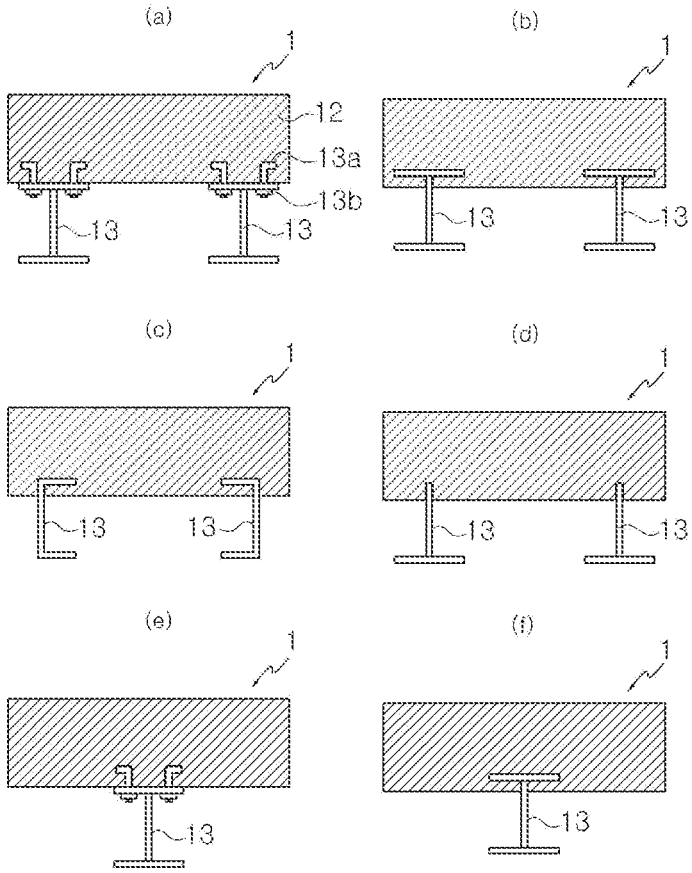
FIG. 5 is a cross-sectional view illustrating an exemplary embodiment of the present invention.

FIG. 5 is a cross-sectional view illustrating an exemplary embodiment of the present invention, and illustrates various examples, each of which includes a concrete plate and at least one steel support beam fixed to a lower portion of the concrete plate such that precast concrete deck members are connected in longitudinal and transverse directions.

Figure 6:
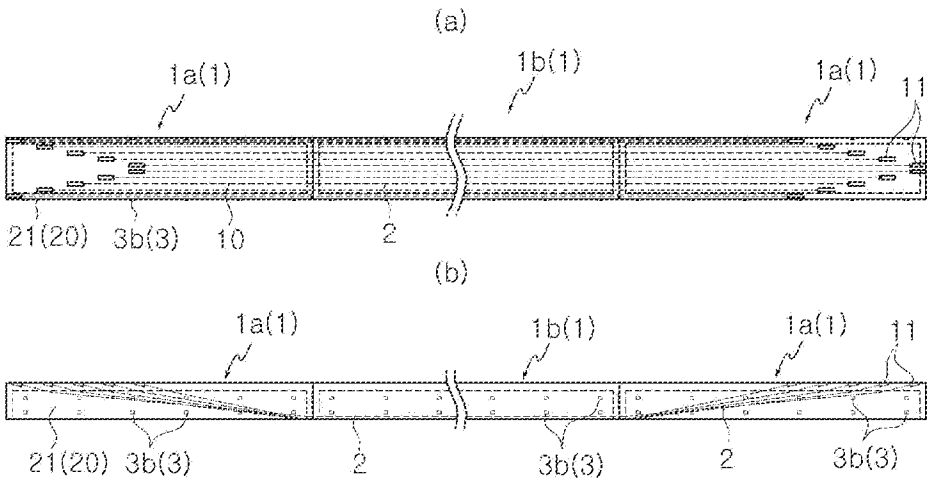
FIGS. 6 to 9 illustrate examples of fixing pre-stressed members according to an exemplary embodiment of the present invention.
Figure 7:
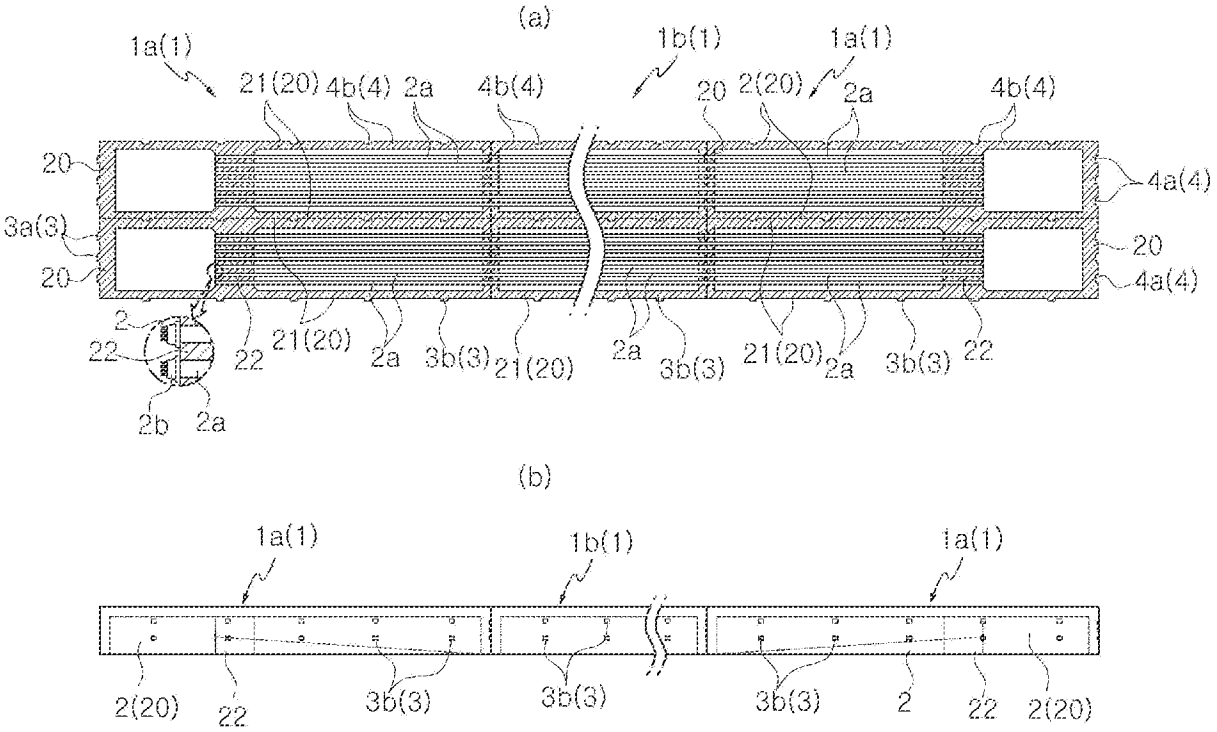
Figure 8:
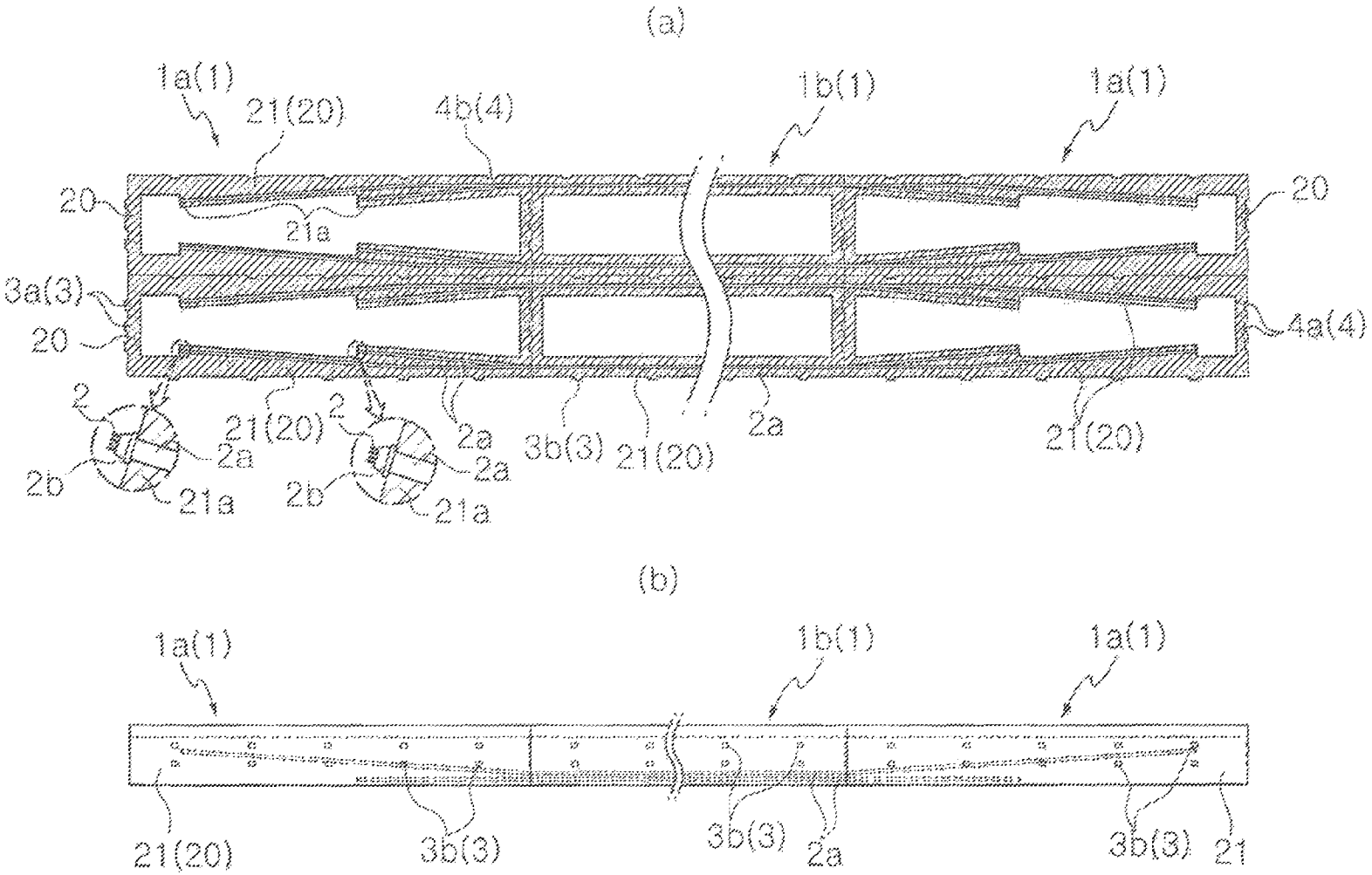
Figure 9:
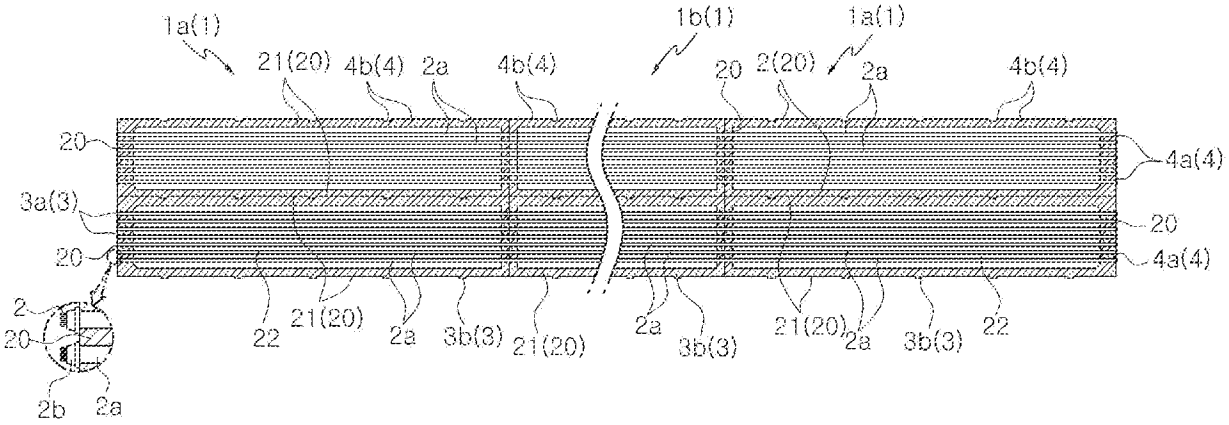

FIGS. 6 to 9 illustrate examples of fixing pre-stressed members according to an exemplary embodiment of the present invention, wherein FIG. 6 illustrates an example in which the pre-stressed members are fixed to an upper plate at a predetermined length, and FIGS. 7 to 9 are cross-sectional views illustrating an exemplary embodiment of the present invention, and illustrate examples of fixing pre-stressed members, which are fixed to a box-shaped precast concrete deck member, to a body via guide pipes.

Figure 10:
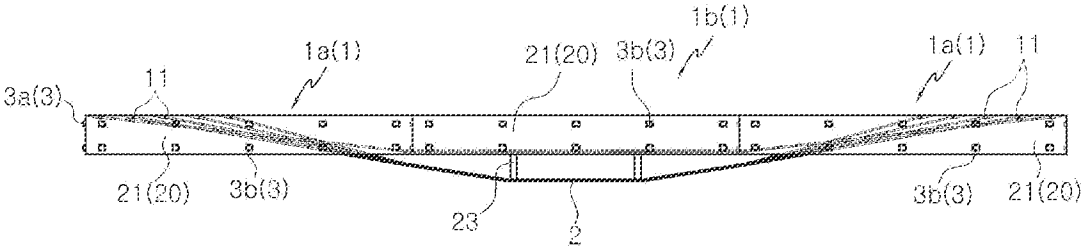
FIGS. 10 to 15 are side views illustrating another exemplary embodiment of the present invention.

FIGS. 10 to 15 are side views illustrating another exemplary embodiment of the present invention, wherein FIG. 10 illustrates an example in which an eccentricity adjustor protrudes downwardly from precast concrete deck members between the other precast concrete deck members located at opposite ends in short span construction, and FIGS. 11 to 15 illustrate examples of a deck serialization structure in which a plurality of precast concrete deck members are assembled between the other precast concrete deck members located at opposite ends of the deck serialization structure.

Figure 16:
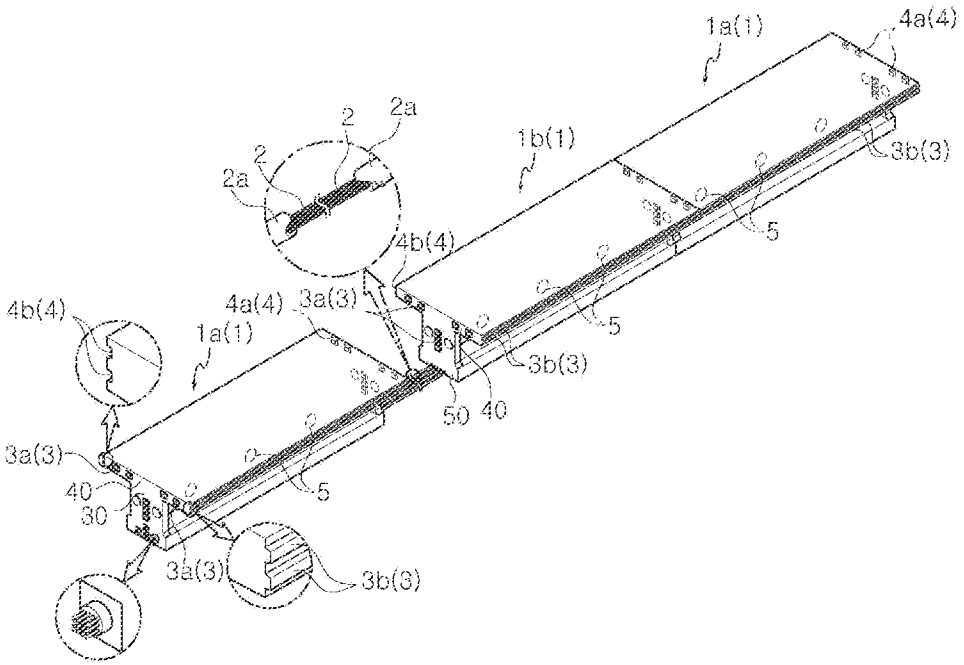
FIG. 16 is an exploded perspective view illustrating another exemplary embodiment of the present invention.

FIG. 16 is an exploded perspective view illustrating another exemplary embodiment of the present invention, and illustrates an example of a precast concrete deck member in which a flange is formed at one end of a web.

Figure 17:
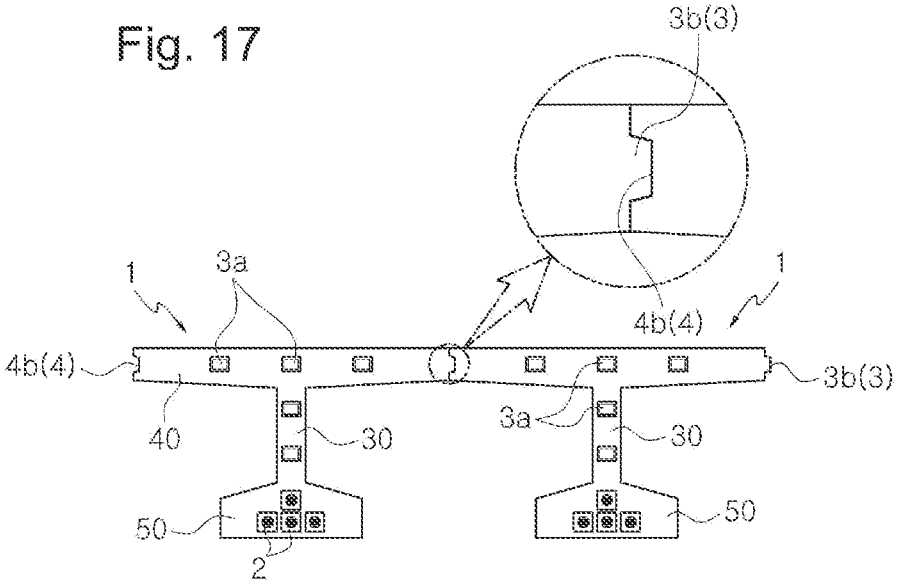
FIGS. 17 to 19 are front views illustrating examples of a transverse connection structure of the precast concrete deck member of FIG. 16.
Figure 18:
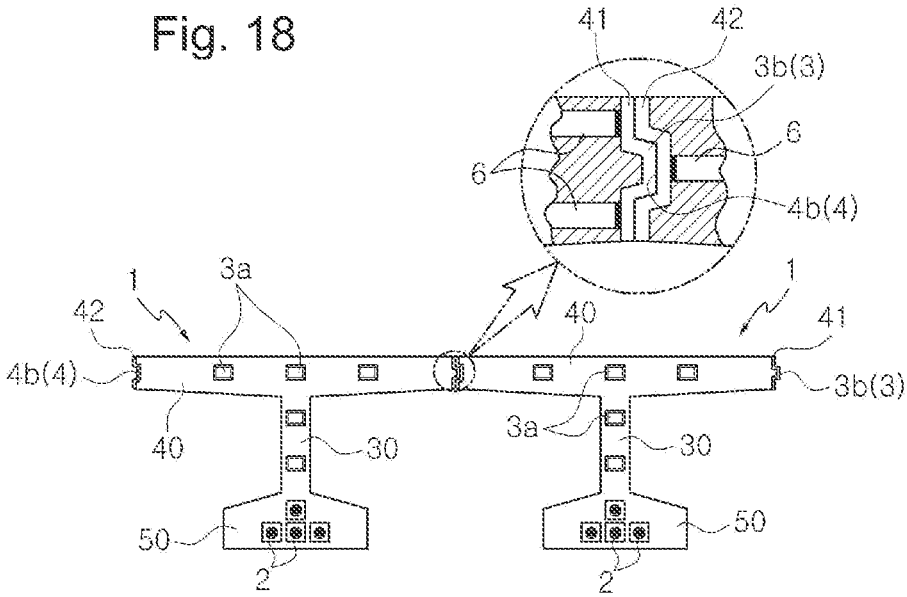
Figure 19:
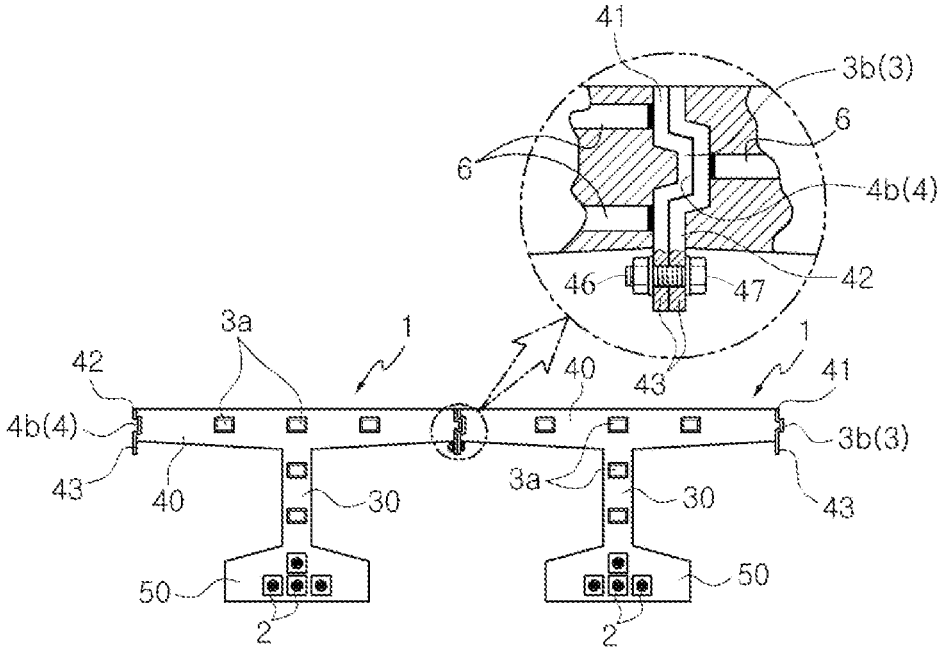

FIGS. 17 to 19 are front views illustrating examples of a transverse connection structure of the precast concrete deck member of FIG. 16, wherein FIG. 17 illustrates an example in which shear keys integrally protrude from one of flanges for connection, and FIGS. 18 and 19 illustrate examples in which first and second side plates having a male-and-female structure are mated with each other on opposite sides of a flange.

Figure 20:
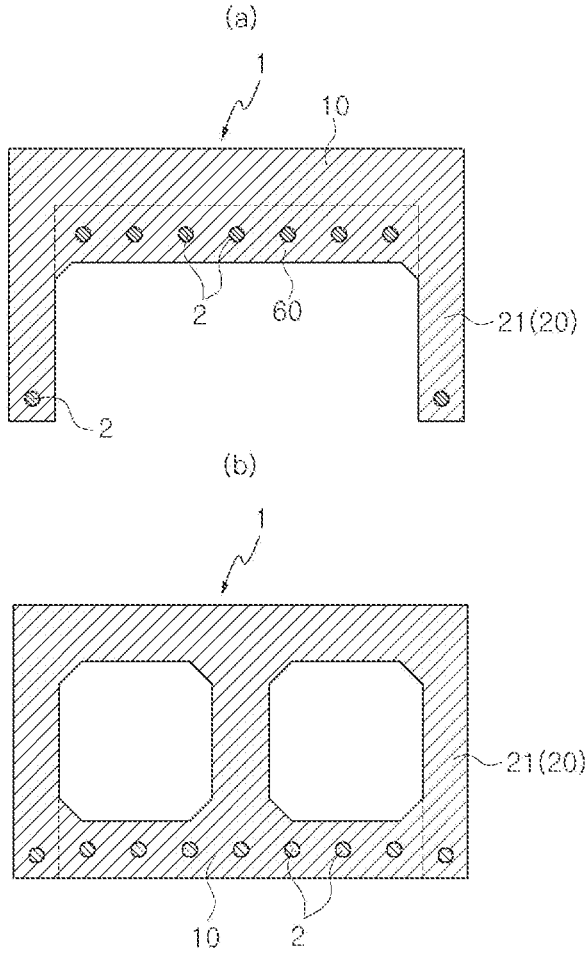
FIGS. 20 and 21 are cross-sectional views illustrating yet another exemplary embodiment of the present invention.
Figure 21:
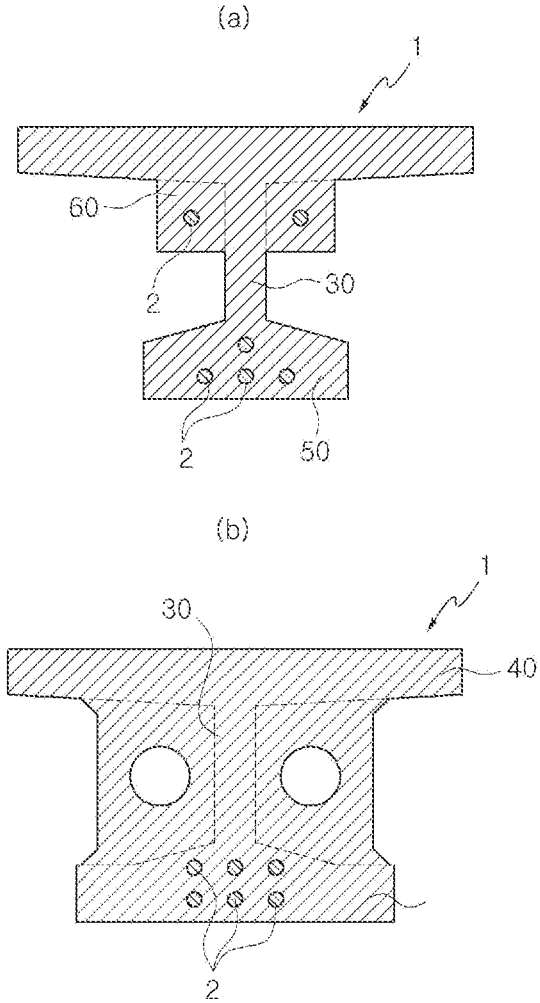

FIGS. 20 and 21 are cross-sectional views illustrating yet another exemplary embodiment of the present invention, and illustrate examples of forming an auxiliary anchor so as to be able to additionally install pre-stressed members on a precast concrete deck member.

Figure 22:
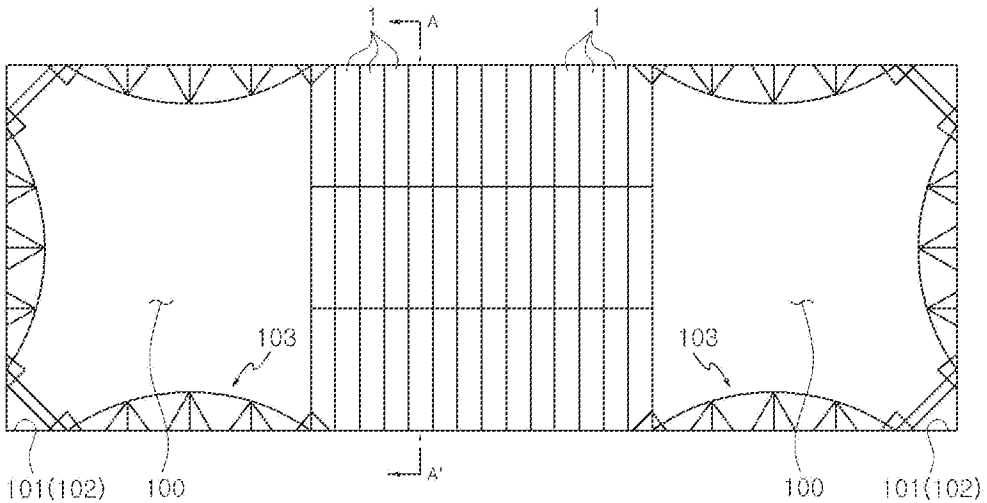
FIG. 22 is a schematic plan view illustrating the state where the present invention is used.
Figure 23:
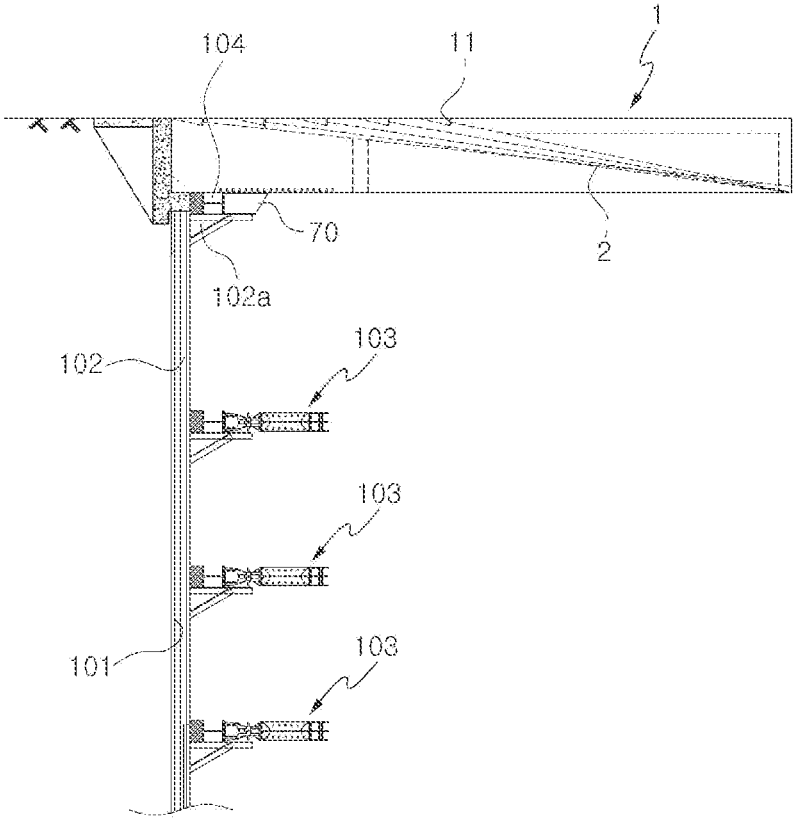
FIG. 23 is an enlarged cross-sectional view of important parts which is taken along line A-A' of FIG. 22.

FIG. 22 is a schematic plan view illustrating the state where the present invention is used. FIG. 23 is an enlarged cross-sectional view of an important part which is taken along line A-A' of FIG. 22, and illustrates an example of constructing precast concrete deck members so as to replace a first-stage one of multistage temporary frameworks supporting wall piles for walls of excavated ground.

FIGS. 24 to 28 are enlarged cross-sectional views of important parts which illustrate another exemplary embodiment of the present invention, and illustrate examples of installing a precast concrete deck member, an end of which is supported on a wall pile, wherein a movable anchor bracket member is configured to be installed under the end of the precast concrete deck member with no gap between the installed site and the precast concrete deck member.

As illustrated in FIGS. 1 to 4, a precast concrete deck member 1 of the present invention is basically manufactured in the shape of a box in which a space is defined by an upper plate 10 having a rectangular shape and sidewalls 20 protruding downwardly from the outer circumference of the upper plate 10.

Figure 4:
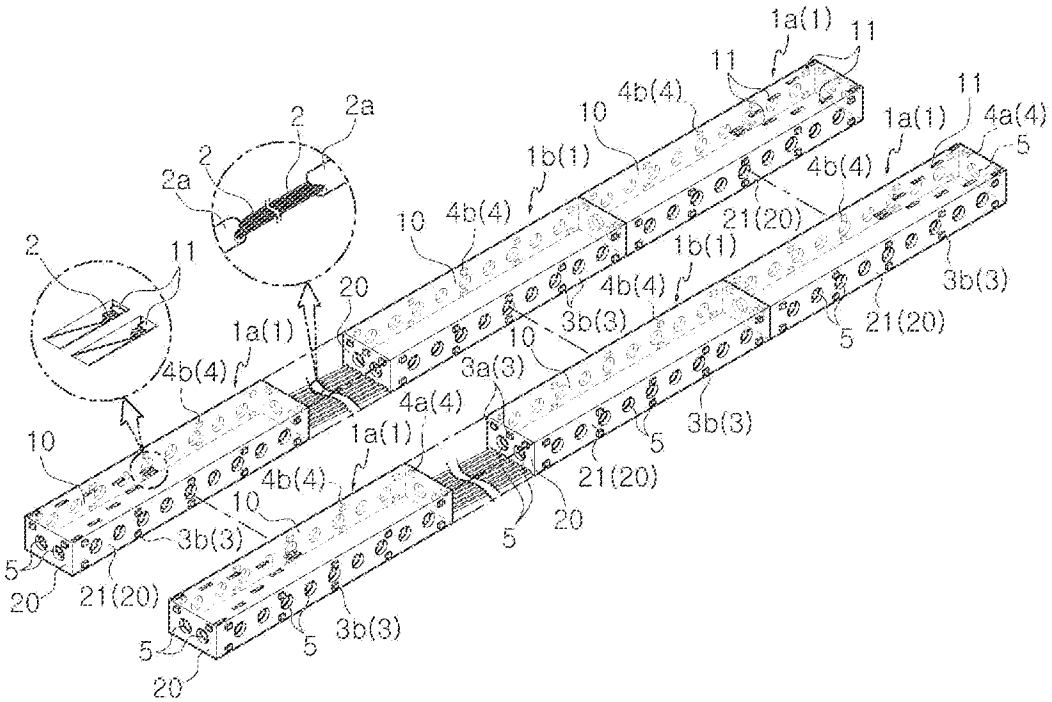

Further, as illustrated in FIG. 4, the precast concrete deck member 1 of the present invention may be configured so that a plurality of through-holes 5 are bored through its body at predetermined intervals.

The plurality of through-holes 5 are formed either in the sidewalls 20 of the box-shaped precast concrete deck member 1 at predetermined intervals or in the web 30 of a T-shaped precast concrete deck member 1, which will be described below, at predetermined intervals, thereby reducing the total weight of the precast concrete deck member 1 and improving the beauties of the precast concrete deck member 1.

The precast concrete deck member 1 is constituted of a plurality of precast concrete deck members, which are connected in a longitudinal direction, i.e., in a lengthwise direction, and among which outermost precast concrete deck members 1*a* are located at opposite ends thereof and an intermediate precast concrete deck member 1*b* is located between the outermost precast concrete deck members 1*a*.

Figure 1:
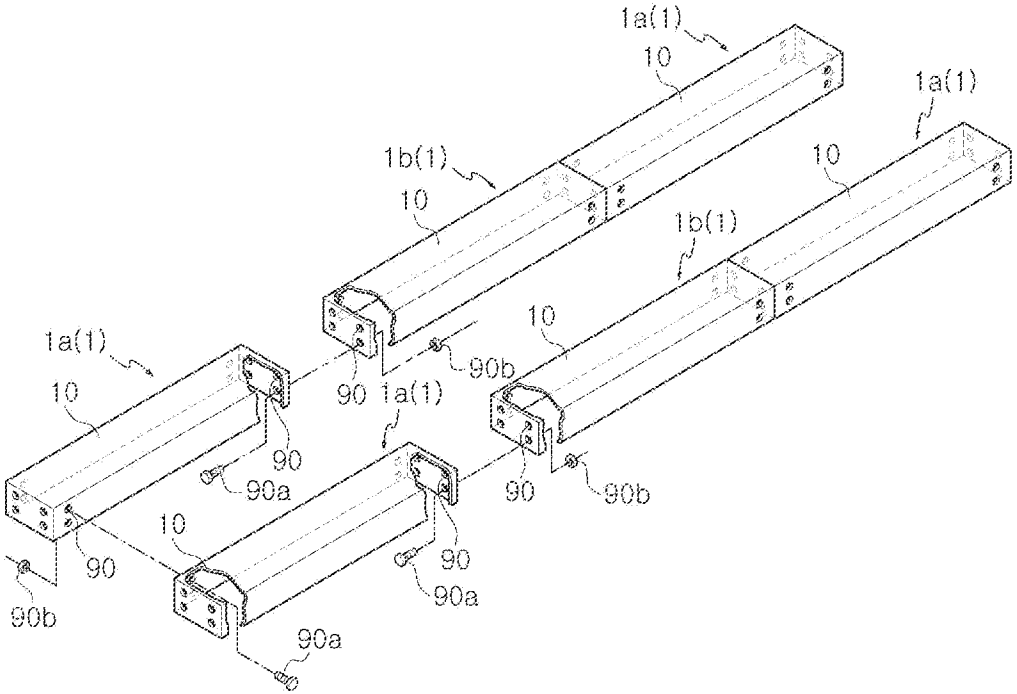
FIGS. 1 to 4 are exploded perspective views illustrating an exemplary embodiment of the present invention.

The precast concrete deck members 1 may be connected in longitudinal and transverse directions, and provided with fastening holes 90 in the front and rear sidewalls and the opposite lateral sidewalls as illustrated in FIG. 1. Thus, the precast concrete deck members 1 may be assembled by fastening means such as bolts 90*a* and nuts 90*b*.

Figure 2:
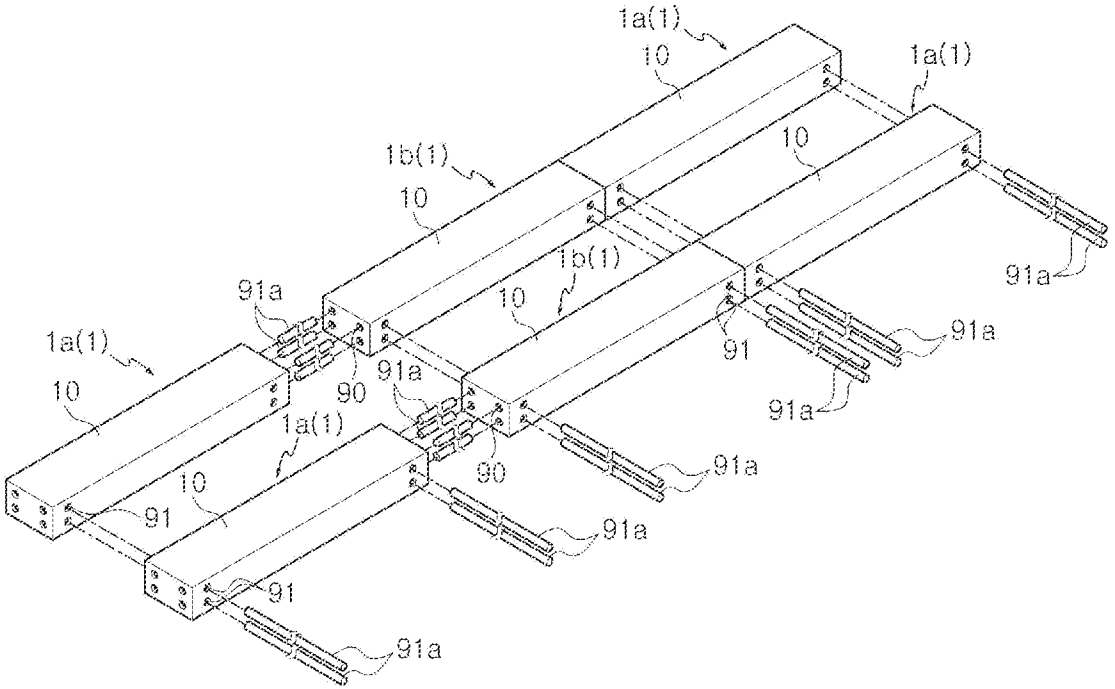

As illustrated in FIG. 2, the precast concrete deck members 1 may be connected in longitudinal and transverse directions using fastening steel bars 91*a* passing through a plurality of coupling holes 91, which are formed in the sidewalls 20 of each precast concrete deck member 1, so as to hold the longitudinal and transverse connection.

Figure 3:
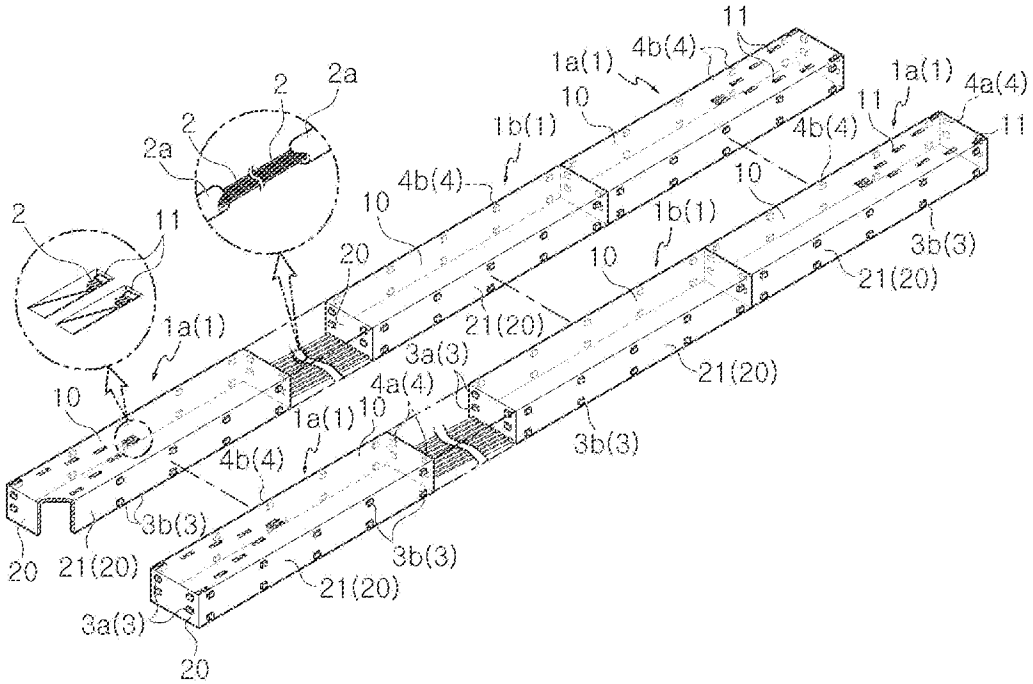

As illustrated in FIG. 3, each precast concrete deck member 1 may include one pair of junction sidewalls facing each other so as to be connected in longitudinal and transverse directions. Shear keys 3 protrude from one of the paired junction sidewalls, and key insertion grooves 4 into which the shear keys 3 are inserted are formed in the other of the paired junction sidewalls. Thus, the precast concrete deck members 1 may be connected in the longitudinal and transverse directions by junction of the shear keys 3.

In the present invention, it should be noted that, on the basic assumption that the longitudinal direction corresponds to the lengthwise direction of the precast concrete deck member 1 and that the transverse direction corresponds to the widthwise direction of the precast concrete deck member 1, the longitudinal and transverse directions as described below refer to the lengthwise and widthwise directions of the precast concrete deck member 1, respectively.

The shear keys 3 may protrude from one of the junction sidewalls in an arbitrary shape at predetermined intervals. Although not illustrated, the shear keys 3 may be continuously formed so as to extend on the junction sidewall in the lengthwise direction.

In detail, longitudinal shear keys 3*a* protrude from one of the longitudinal junction sidewalls of each precast concrete deck member 1, and longitudinal key insertion grooves 4*a* are formed in the other longitudinal junction sidewall. The longitudinal shear keys 3*a* are inserted into the longitudinal key insertion grooves 4*a* in the junction sidewalls of the precast concrete deck members 1 facing each other, so that the precast concrete deck members 1 are connected in the longitudinal direction.

Further, transverse shear keys 3*b* protrude from one of the transverse junction sidewalls of each precast concrete deck member 1, and transverse key insertion grooves 4*b* are formed in the other transverse junction sidewall. The transverse shear keys 3*b* are inserted into the transverse key insertion grooves 4*b* on the junction sidewalls of the precast concrete deck members 1 facing each other, so that the precast concrete deck members 1 are connected in the transverse direction.

The shear keys 3 are inserted into and joined in the insertion grooves 4 when the precast concrete deck members 1 are connected in the longitudinal and transverse directions. The precast concrete deck members 1 are connected in the longitudinal and transverse directions, thereby becoming a deck structure. In this state, the deck structure supports a shear force caused by the load applied from the top, thereby firmly holding the connection of the precast concrete deck members 1.

Meanwhile, as illustrated in FIG. 5, the precast concrete deck members 1 includes a concrete plate 12 that can be connected in the longitudinal and transverse directions, and at least one steel beam 13 fixed to a lower portion of the concrete plate 12 and supporting the concrete plate 12 at an arbitrary height.

The steel beam 13 serves as a main girder when a deck or temporary bridge is constructed, and thus is easily used when a structure of the main girder is required.

As illustrated in FIGS. 5(*a*) to 5(*d*), two steel beams 13 may be mounted on opposite sides of the lower portion of the concrete plate 12 in a vertical direction. As in FIGS. 5(*e*) and 5(*f*), one steel beam 13 may be mounted in the middle of the lower portion of the concrete plate 12 in a vertical direction.

As illustrated in FIGS. 5(*a*), 5(*b*), 5(*e*) and 5(*f*), as the steel beam 13, an H steel beam may be used to fix an upper flange thereof to the lower portion of the concrete plate 12.

As illustrated in FIGS. 5(*a*) and 5(*e*), the H steel beam may be fixedly mounted on the lower portion of the concrete plate 12 by passing an anchor bolt 13*a*, one end of which is bent and embedded in the concrete plate 12 and the other end of which is threaded and protrudes outwardly from the lower portion of the concrete plate 12, through the upper flange thereof, and fastening a nut 13*b* to the threaded other end of the anchor bolt 13*a*. As illustrated in FIGS. 5(*b*) and 5(*f*), the H steel beam may be integrally and fixedly mounted on the concrete plate 12 by embedding the upper flange thereof in the concrete plate 12.

Further, as illustrated in FIGS. 5(*c*) and 5(*d*), a C or T steel beam may be used as the H steel beam, and integrally and fixedly mounted on the concrete plate 12 by embedding the upper flange thereof in the concrete plate 12.

Meanwhile, as illustrated in FIG. 3, the pre-stressed members 2 are fixed to the precast concrete deck members 1, which are connected in the longitudinal direction, at opposite ends thereof, and then are pre-stressed inside or outside the precast concrete deck members 1 to generate a compressive force.

It should be noted that any well-known members, such as strands, steel wires, and cables, which are pre-stressed to have a recovery force to be recovered to their original state, may be used as the pre-stressed members 2.

The pre-stressed members 2 are fixed to upper anchors 11 provided on one side of the upper plate 10 of each precast concrete deck member 1.

The upper anchors 11 may be provided on one side of the upper plate 10 at predetermined intervals, and distribute stress concentration caused by the fixation of the pre-stressed members 2, so that the upper anchors 11 can prevent the precast concrete deck member 1 from being damaged by concentrating a compressive force, which reacts against a tensile force of the pre-stressed members 2, in one place.

The upper anchors 11 are basically provided at ends of the upper plates 10 of the outermost precast concrete deck members 1 located on the opposite outermost ends at predetermined intervals when the precast concrete deck members 1 are connected in the longitudinal direction, wherein the upper anchors 11 are provided on the upper plates 10 of the opposite outermost precast concrete deck members 1 in symmetry.

Further, as illustrated in FIG. 6, the upper anchors 11 are provided on the ends of the upper plates 10 of the outermost precast concrete deck members 1 located on the opposite outermost ends at predetermined intervals when the precast concrete deck members 1 are connected in the longitudinal direction, wherein the pre-stressed members 2 are constant in length such that the fixed pre-stressed members 2 have the same length. Because of this standardization of the pre-stressed members 2, it is possible to easily manufacture, install, and maintain the pre-stressed members 2.

The upper anchors 11 of the outermost precast concrete deck members 1 located on the opposite outermost ends may be connected with guide pipes 2*a* such that the opposite ends of each pre-stressed member 2 are accurately fixed at opposite fixture places by guiding each pre-stressed member 2 in the corresponding guide pipe 2*a* so as to reach the fixture place of each pre-stressed member 2.

Further, each pre-stressed member 2 passes through the lower portion of each intermediate precast concrete deck member 1, and then is fixed to the upper anchors 11 of the outermost precast concrete deck members 1.

In detail, the opposite ends of each pre-stressed member 2 pass through the intermediate precast concrete deck member 1, and are fixed to the upper anchors 11 of the outermost precast concrete deck members 1. Thereby, each pre-stressed member 2 is pre-stressed to provide a compressive force to the outermost and intermediate precast concrete deck members 1, and thus increases resistance to a tensile force generated by the load applied from the top, thereby increasing rigidity.

As illustrated in FIG. 7, each pre-stressed member 2 may be fixed to transverse fixtures 22, which are provided between the longitudinal sidewalls 21 formed in the lengthwise direction, i.e., in the longitudinal direction, among the sidewalls 20 of each precast concrete deck member 1.

Opposite ends of each transverse fixture 22 are integrally formed with the longitudinal sidewalls 21 of the precast concrete deck member 1, and are supported between the longitudinal sidewalls 21 of the precast concrete deck member 1, so that each transverse fixture 22 reinforces rigidity and is fixed by one of the opposite ends of each pre-stressed member 2.

The transverse fixtures 22 are provided between the longitudinal sidewalls 21 of the outermost precast concrete deck members 1 located on the opposite outermost ends when the precast concrete deck members 1 are connected in the longitudinal direction, and each includes a plurality of anchors 2*b* to which the ends of the pre-stressed members 2 are fixed at predetermined intervals, thereby distributing stress concentration caused by the fixation of the pre-stressed members 2.

Guide pipes 2*a* connecting the anchors 2*b* of the transverse fixtures 22 provided on each precast concrete deck member 1 are provided between the outermost precast concrete deck members 1 such that the opposite ends of each pre-stressed member 2 are accurately fixed to the opposite anchors 2*b* by guiding each pre-stressed member 2 in the corresponding guide pipe 2*a*.

In detail, the opposite ends of each pre-stressed member 2 pass through the intermediate precast concrete deck member 1, and are fixed to the anchors 2*b* of the transverse fixtures 22 of the outermost precast concrete deck members 1 in a tensioned state. Thereby, each pre-stressed member 2 provides a compressive force to the outermost precast concrete deck members 1 and the intermediate precast concrete deck members 1 which are connected with each other, and thus increases resistance to a tensile force generated by the load applied from the top, thereby increasing rigidity.

Further, as illustrated in FIG. 8, the pre-stressed members 2 may be inserted into the guide pipes 2*a* extending and fixed in the lengthwise direction of the opposite longitudinal sidewalls 21 of the precast concrete deck member 1, and fixed to ends of the opposite longitudinal sidewalls 21.

Each guide pipe 2*a* is provided with the anchors 2*b*, to which the ends of each pre-stressed member 2 are fixed, at opposite ends thereof.

Each guide pipe 2*a* is basically inserted into and fixed to a wedge 21*a*, which protrudes inwardly from each longitudinal sidewall 21 of the precast concrete deck member 1 by increasing the thickness of each longitudinal sidewall 21.

The wedge 21*a* serves to increase the thickness of each longitudinal sidewall 21 in order to not only fix each pre-stressed member 2 but also prevent stress concentration caused by the fixation.

Further, as illustrated in FIG. 9, each guide pipe 2*a* may pass through the numerous precast concrete deck members 1 connected in the longitudinal direction, and opposite ends thereof may be fixed to outer ends of the outermost precast concrete deck members 1 located at the opposite ends.

The outer ends of the outermost precast concrete deck members 1 located at the opposite ends are provided with anchors 2*b*, which are provided on the opposite ends of the guide pipe 2*a* and to which the ends of the pre-stressed member 2 are fixed, so as to be exposed.

Meanwhile, as illustrated in FIG. 10, the precast concrete deck member 1 is provided with an eccentric extension 23, which protrudes downwardly between the positions where the opposite ends of the pre-stressed member 2 are fixed, thereby increasing the eccentric length of the pre-stressed member 2 to enhance the tensile force of the pre-stressed member 2.

In a short span deck structure configured of two outermost precast concrete deck members 1, which are located at opposite ends thereof in the longitudinal direction and to which the opposite ends of the pre-stressed member 2 are fixed, and an intermediate precast concrete deck member 1*b* located between the outermost precast concrete deck members 1, the eccentric extension 23 basically protrudes downwardly from the intermediate precast concrete deck member 1*b* at an arbitrary length.

Although not illustrated, the eccentric extension 23 may be fixed to a hydraulic jack mounted on a lower surface of the upper plate 10 so as to enable the length protruding downwardly from the precast concrete deck member 1 to be adjusted. A slidable or movable bar may be coupled to a stationary bar fixed to the upper plate, and a lock part may be provided to move the movable bar. Thereby, the movable bar may slide to be fixed by the lock part, so that the eccentric extension 23 may adjust the length protruding downwardly from the precast concrete deck member 1. In addition to this configuration, a well-known length adjustment structure may be used.

As described above, since the eccentric extension 23 can adjust the eccentric length, it is possible to adjust the tensile force of the pre-stressed members 2 according to the load applied to the deck structure to be constructed when the deck structure is designed.

Figure 11:
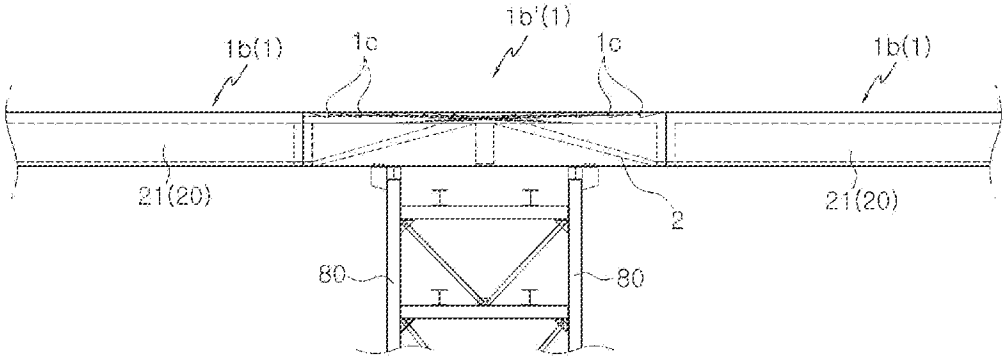

Meanwhile, as illustrated in FIG. 11, the precast concrete deck member 1 of the present invention is to be constructed into a deck serialization structure having a plurality of intermediate precast concrete deck members 1*b* between the outermost precast concrete deck members 1.

Further, as illustrated in FIGS. 12 to 15, in the deck serialization structure having the plurality of intermediate precast concrete deck members 1*b* between the outermost precast concrete deck members 1, the middle precast concrete deck member 1*b*' supported by a middle post pile structure 80 among the intermediate precast concrete deck members 1*b* may be configured to have a wider cross-sectional area than the other intermediate precast concrete deck members 1*b* connected with the outermost precast concrete deck members 1, thereby increasing rigidity against negative moment.

Figure 12:
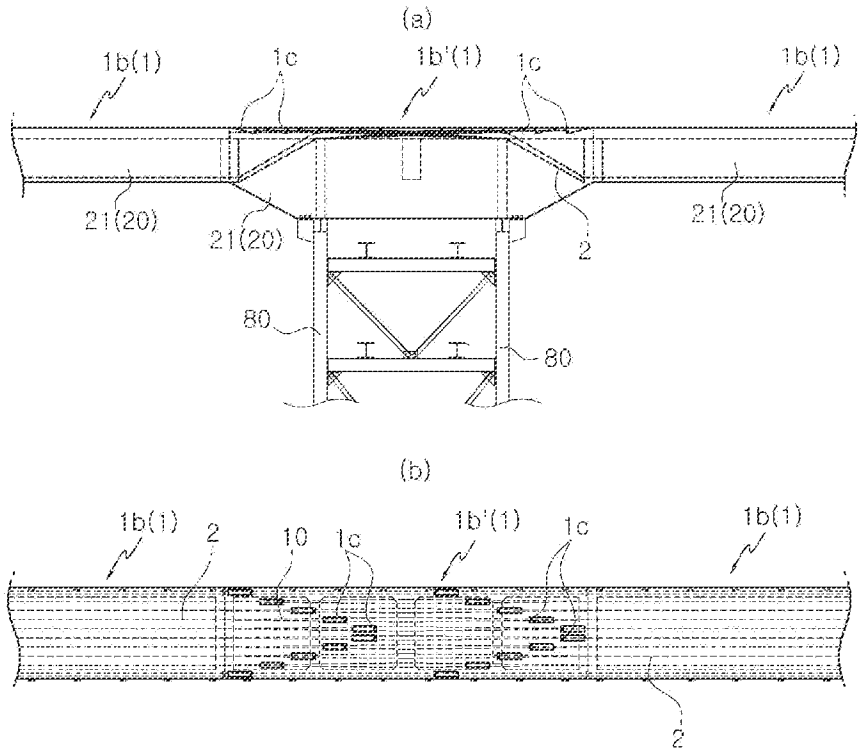
Figure 14:
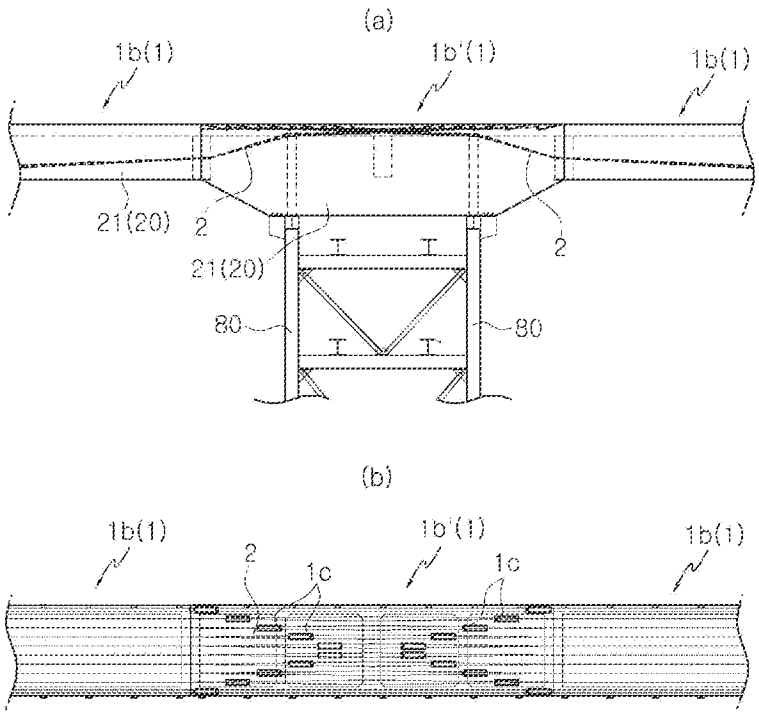

As illustrated in FIGS. 12 and 14, anchors 1*c* to which first ends of the pre-stressed members 2 in the deck serialization structure may be provided on the middle precast concrete deck member 1*b*' supported by the middle post pile structure 80 among the intermediate precast concrete deck members 1*b*.

Figure 13:
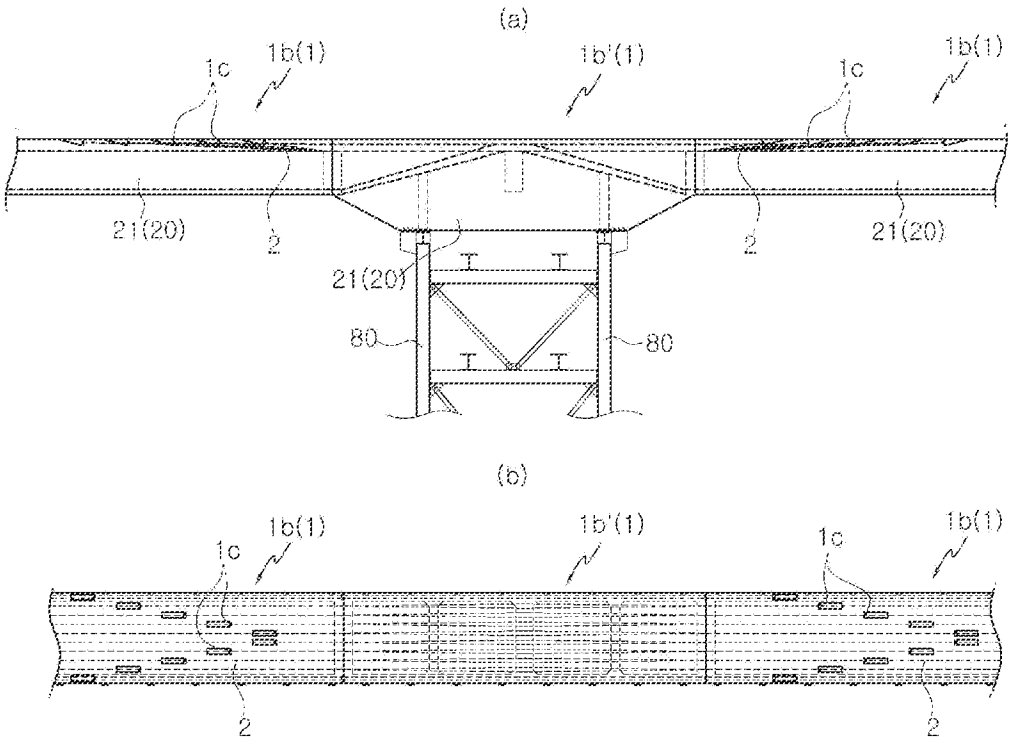
Figure 15:
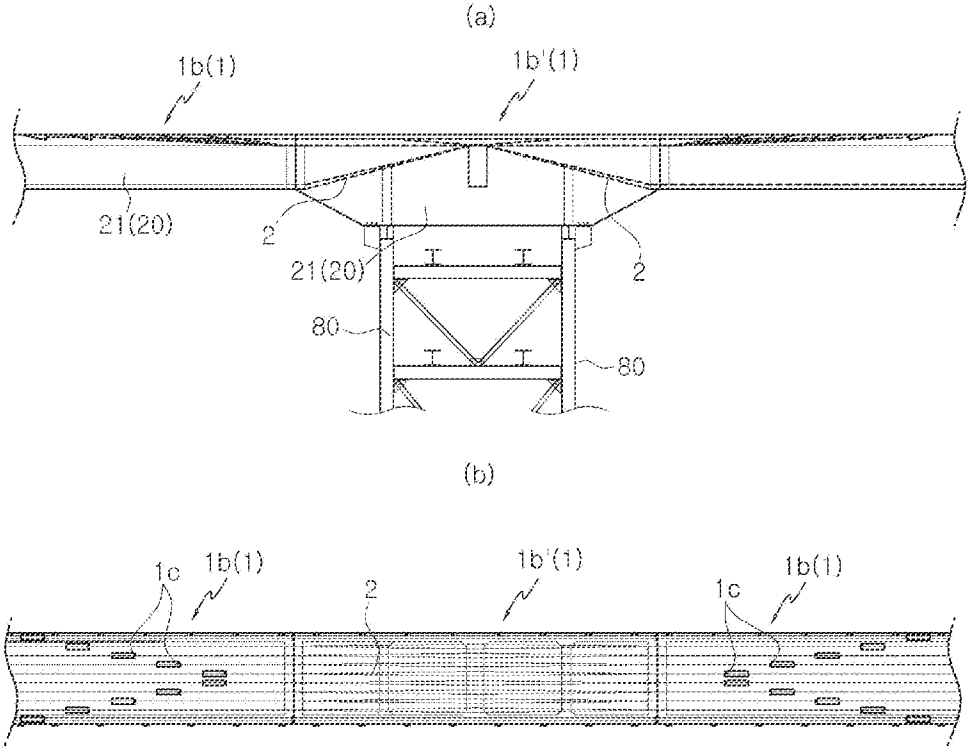

As illustrated in FIGS. 13 and 15, the anchors 1*c* may be provided on the intermediate precast concrete deck members 1*b* located on the opposite sides of the middle precast concrete deck member 1*b*' supported by the middle post pile structure 80 among the intermediate precast concrete deck members 1*b*.

The anchors 1*c* are provided to correspond to the upper anchors 11 or the anchors 2*b* of the transverse fixtures 22 of the outermost precast concrete deck members 1 connected at the opposite ends of the deck serialization structure, and are fixed by the first ends of the pre-stressed members 2, the second ends of which are fixed to the outermost precast concrete deck members 1 that are opposite to each other with respect to the middle precast concrete deck member 1*b*' supported by the post pile structure 80.

Further, when provided on the plurality of intermediate precast concrete deck member 1*b*, the anchors 1*c* may be provided to arbitrarily adjust the lengths of the pre-stressed members 2 as illustrated in FIGS. 12 and 13, or to make lengths of the pre-stressed members 2 constant such that the fixed pre-stressed members 2 have the same length as illustrated in FIGS. 14 and 15. Because of this standardization of the pre-stressed members 2, it is possible to easily manufacture, install, and maintain the pre-stressed members 2.

The intermediate precast concrete deck member 1*b* having the anchors 1*c* is used in consideration of the lengths of the pre-stressed members 2 and convenient construction when the deck structure is designed.

Meanwhile, as illustrated in FIG. 16, the precast concrete deck member 1 may be manufactured to have a T-shaped body that a flange 40 is formed on top of a web 30.

The web 30 has through-holes 5 formed at predetermined intervals, thereby reducing the total weight and improving the beauties.

The web 30 is provided with a lower support 50, on which the pre-stressed members 2 are mounted, at a lower end thereof. Guide pipes 2*a* are inserted into the lower support 50 in a lengthwise direction. The pre-stressed members 2 are inserted into the guide pipes 2*a* communicating with each other when the precast concrete deck members 1 are interconnected in the longitudinal direction.

Each guide pipe 2*a* is provided with an anchor 2*b*, to which one end of each pre-stressed member 2 is fixed, at one end thereof. The plurality of anchors 2*b* are provided on the lower support 50 at predetermined intervals, thereby distributing stress concentration caused by the fixation of the pre-stressed members 2.

The flange 40 and the web 30 are provided with longitudinal shear keys 3*a* and longitudinal key insertion grooves 4*a* in opposite longitudinal end surfaces thereof, i.e., in longitudinal front and rear surfaces thereof, so that they are continuously connected in the longitudinal direction.

Further, as illustrated in FIGS. 17 to 19, the flange 40 has at least one transverse shear key 3*b* protruding from one side thereof and at least one transverse key insertion groove 4*b* engaged with the transverse shear keys 3*b* on the other side thereof, so that the flanges 40 are connected in the transverse direction.

As illustrated in FIG. 17, the flange 40 may be provided with a transverse shear key 3*b*, which integrally protrudes from the flange 40, and a transverse key insertion groove 4*b*, which is integrally grooved in the flange 40, on opposite sides thereof.

As illustrated in FIG. 18, the flange 40 may be provided with a first side plate 41, which is formed of steel and from which the transverse shear key 3*b* protrudes, and a second side plate 42, which is formed of steel and has the transverse key insertion groove 4*b* engaged with the transverse shear keys 3*b*, on opposite sides thereof.

Further, as illustrated in FIG. 19, the first and second side plates 41 and 42 include bolted flange joints 43 extending downwardly therefrom. A joint bolt 46 passes through the flange joints 43, and then a nut 47 is fastened to an end of the joint bolt 46, so that the flanges 40 can be more firmly joined with each other.

The first and second side plates 41 and 42 may be welded to at least one reinforcement rod 6 embedded in the precast concrete deck member 1.

Meanwhile, the precast concrete deck member 1 is formed in the box shape in which the sidewalls 20 protrude downwardly from the outer circumference of the upper plate 10 having an arbitrary shape, so that the sidewalls 20 serve as the main girder when the deck structure is installed. As a result, the deck structure can be installed without a separate main girder.

Further, the precast concrete deck member 1 has the T-shaped body in which the flange 40 is formed on top of the web 30, so that the web 30 and the lower support 50 formed on the lower portion of the web 30 serve as the main girder when the deck structure is installed. As a result, the deck structure can be installed without a separate main girder.

As illustrated in FIGS. 20 and 21, the precast concrete deck member 1 may have at least one auxiliary anchor 60 on one side thereof such that the pre-stressed members 2 can be additionally installed.

As illustrated in FIG. 20, in the precast concrete deck member 1 formed in the box shape in which the sidewalls 20 protrude downwardly from the outer circumference of the upper plate 10 having an arbitrary shape, the auxiliary anchor 60 is formed to protrude from inner surfaces of the longitudinal sidewalls 21.

Here, FIG. 20(*a*) is a cross-sectional view of the precast concrete deck member 1 at an anchor to which the pre-stressed members 2 are fixed, and FIG. 20(*b*) is a cross-sectional view of a joint where two precast concrete deck members 1 are connected to each other. It is shown that the pre-stressed members 2 pass through below the joint and then are fixed to the auxiliary anchor 60 installed on the lower portion of the upper plate 10.

Further, as illustrated in FIG. 21, in the precast concrete deck member 1 having the T-shaped body in which the flange 40 is formed on top of the web 30, the auxiliary anchors 60 are formed on both sides of the web 30 so as to protrude therefrom.

Here, FIG. 21(*a*) is a cross-sectional view of the precast concrete deck member 1 at an anchor to which the pre-stressed members 2 are fixed, and FIG. 21(*b*) is a cross-sectional view of a joint where the two precast concrete deck members 1 are connected to each other. It is shown that the pre-stressed members 2 pass through below the joint and then are fixed to the auxiliary anchors 60 installed on both sides of the web 30.

The auxiliary anchors 60 are configured such that the pre-stressed members 2 can be additionally installed in consideration of the load generated from the upper portion of the deck structure when the deck structure is designed, and thus have an effect of increasing a degree of freedom when the deck structure is designed.

Meanwhile, as illustrated in FIGS. 22 and 23, the precast concrete deck members 1 of the present invention may be continuously connected on one side of a plane 100 of excavated ground in the longitudinal and transverse directions, and may be constructed so as to replace a first-stage one of multistage temporary frameworks 103 supporting wall piles 102 for excavated walls 101.

The wall piles 102 are installed on the excavated walls 101 within the excavated plane 100, and the temporary frameworks 103 supporting the wall piles 102 are installed between the wall piles 102 in multiple stages. In the present invention, as described above, the precast concrete deck members 1 are continuously connected in the longitudinal and transverse directions, and are constructed into the first-stage temporary framework 103, so that the deck structure in which main girders serving to support the excavated walls 101 are integrated with deck plates is obtained.

Although not illustrated, the main girders and the deck plates continuously connected in the longitudinal and transverse directions may be integrated and constructed into the deck structure in an arbitrary temporary bridge.

As described above, the precast concrete deck member 1 constructed into the first-stage temporary framework 103 on one side of the excavated plane 100 is constructed on one side of the wall piles 101 so as to be in close contact with no gap, as illustrated in FIGS. 24 to 27.

As illustrated in FIGS. 24 to 27, a plurality of bolt insertion grooves 1*d* are formed in the lower surface of the precast concrete deck member 1 of the present invention in a connecting direction at predetermined intervals, i.e., in a longitudinal direction. A movable anchor bracket 70 is provided with installation holes 71, into which installation bolts 72 fastened to the bolt insertion grooves 1*d* are fitted, in an upper portion thereof, and is installed on a lower portion of the end of the precast concrete deck member 1 so as to be movable in the longitudinal direction of the precast concrete deck member 1.

In the box-shaped precast concrete deck member 1, the plurality of bolt insertion grooves 1*d* are formed in a lower edge of the longitudinal sidewall 21 at predetermined intervals. In the T-shaped precast concrete deck member 1, the plurality of bolt insertion grooves 1*d* are formed in a bottom surface of the lower support 50 at predetermined intervals.

The movable anchor bracket 70 is supported and fixed to the wall pile 102 supporting the wall 101 of the excavated ground or an abutment (not shown) of the temporary bridge, and approaches an installed place, i.e., the wall pile 102 or the temporary abutment, until the installation holes 71 are aligned with the bolt insertion grooves 1*d*. Then, the installation bolts 72 are fitted into the installation holes 71, and fastened to the bolt insertion grooves 1*d*. Thereby, it is possible to prevent a gap between the installed place and the precast concrete deck member 1 as well as longitudinal movement of the precast concrete deck members 1 connected in the longitudinal and transverse directions.

Figure 24:
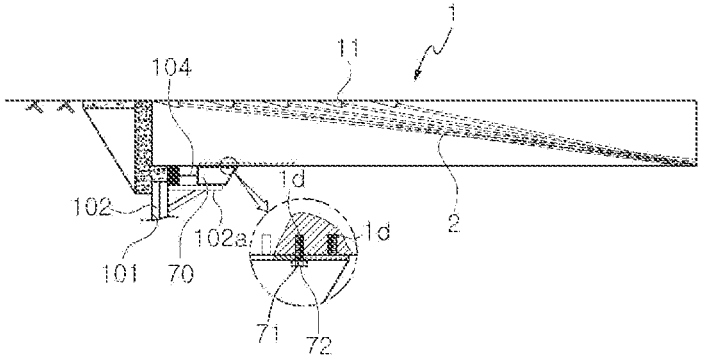
FIGS. 24 to 28 are enlarged cross-sectional views of important parts which illustrate another exemplary embodiment of the present invention.

As illustrated in FIG. 24, the movable anchor bracket 70 is placed on a support 102*a* installed on an upper end of the wall pile 102. In detail, the movable anchor bracket 70 is closely placed on and fixed to either a spacer such as an H section beam or a wale 104 installed on the support 102*a* to support the wall pile 102, and then can be fastened to a lower portion of the end of the precast concrete deck member 1 using the installation bolts 72.

Figure 25:
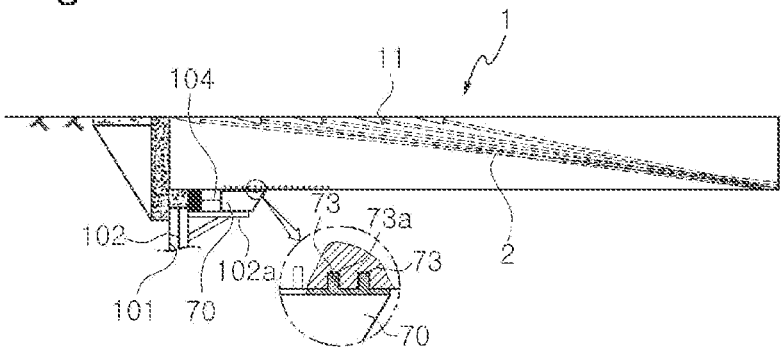

Further, as illustrated in FIG. 25, a plurality of pin insertion grooves 73*a* are formed in a lower edge of the longitudinal sidewall 21 of the precast concrete deck member 1 at predetermined intervals. A plurality of pins 73 inserted into the pin insertion grooves are formed on the top surface of the movable anchor bracket. The movable anchor bracket 70 approaches the installed place, i.e., the wall pile 102 or the temporary abutment (not shown) such that the pins 73 are inserted into the pin insertion grooves 73*a*. Thereby, it is possible to prevent a gap between the installed place and the precast concrete deck member 1 as well as longitudinal movement of the precast concrete deck members 1 connected in the longitudinal and transverse directions.

Figure 26:
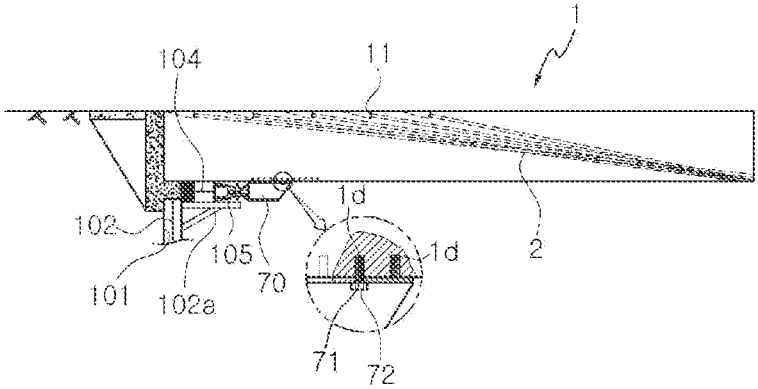

As illustrated in FIG. 26, the movable anchor bracket 70 is placed on a support 102*a* installed on an upper end of the wall pile 102, connected to either a spacer such as an H section beam or a wale 104 supporting the wall pile 102 using a length adjusting jack 105, and displaced by the length adjusting jack 105 such that the installation holes 71 are aligned to the bolt insertion grooves 1*d*. Then, the installation bolts 72 are fitted into the installation holes 71 and fastened to the bolt insertion grooves 1*d*. Thereby, the movable anchor bracket 70 may be installed.

The length adjusting jack 105 is operated similar to a well-known jack that has a hydraulic cylinder and can adjust the length, and adjusts a gap between the movable anchor bracket 70 and the spacer such as the H section beam or the wale 104. This configuration or operation is well known, and thus detailed descriptions thereof will not be repeated.

Figure 27:
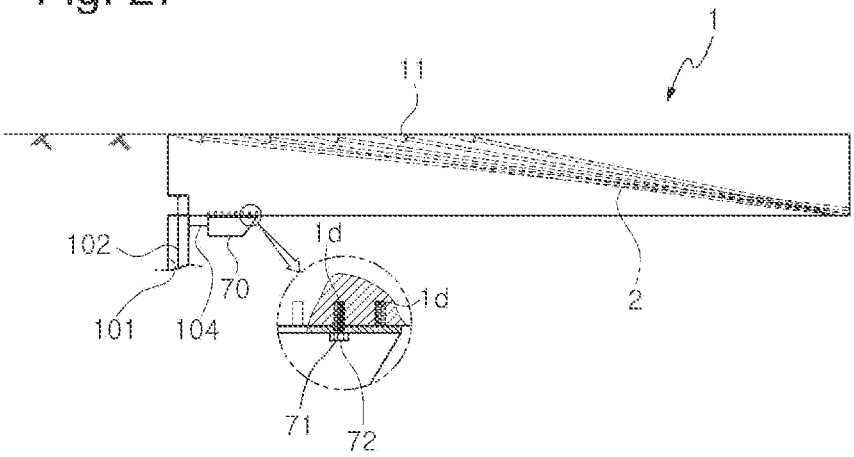

Further, as illustrated in FIG. 27, the movable anchor bracket 70 may be installed by fixing one end thereof to the spacer such as the H section beam or the wale 104 fixed to the wall pile 102, being displaced such that the installation holes 71 are aligned to the bolt insertion grooves 1*d*, fitting the installation bolts 72 into the installation holes 71, and fastening the installation bolts 72 to the bolt insertion grooves 1*d*.

Figure 28:
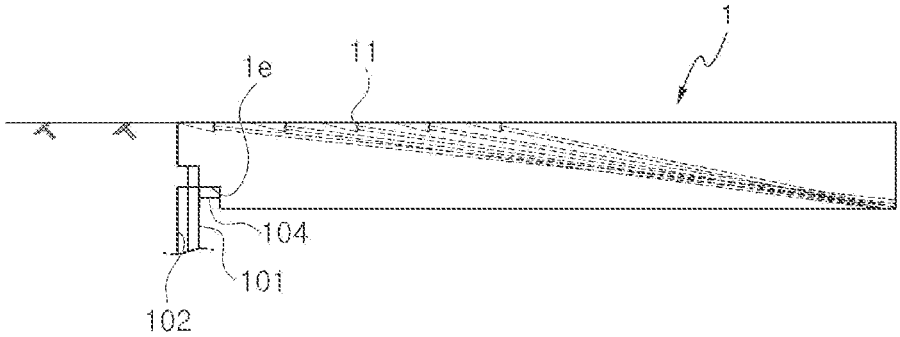

As illustrated in FIG. 28, a spacing insertion recess 1*e*, into which the spacer such as the H section beam or the wale 104 fixed to the wall pile 102 is inserted, is formed in the lower portion of the end of the precast concrete deck member 1. The wale 104 is inserted into the spacing insertion recess 1*e* formed in the lower portion of the end of the precast concrete deck member 1 such that the precast concrete deck member 1 comes into close contact with the wall pile 102. Thereby, it is possible to prevent a gap between the installed place and the precast concrete deck member 1 as well as longitudinal movement of the precast concrete deck members 1 connected in the longitudinal and transverse directions.

Meanwhile, the precast concrete deck member 1 may further increase the rigidity against the tensile force by embedding reinforcement rods 6 in the body thereof. This corresponds to configuration of conventional reinforced concrete, and so detailed description thereof will be omitted.

The present invention is not limited to the disclosed embodiments. Thus, the present invention may be embodied in many different forms without departing from the gist of the present invention. Thus, it should be understood that these modifications are included in the present invention.

The invention claimed is:

1. A fit-together type of precast concrete lining and bridging structural body which is assembled with a plurality of precast concrete deck members formed of a concrete material so as to be connectable in a longitudinal direction and a transverse direction, wherein each precast concrete deck member includes sidewalls protruding downwardly from an outer circumference of an upper plate, and wherein a space is defined by the upper plate and the sidewalls, wherein opposite ends of post-tensioned members generating post-tension in the longitudinal direction over a length of at least one of the precast concrete deck members are fixed to the precast concrete deck members interconnected in the longitudinal direction, wherein the sidewalls include one pair of transverse junction sidewalls facing each other in the longitudinal direction and one pair of longitudinal junction sidewalls facing each other in the transverse direction, wherein shear keys protrude from one of the longitudinal junction sidewalls and one of the transverse junction sidewalls, and key insertion grooves into which the shear keys are insertable are formed in another of the longitudinal junction sidewalls and another of the transverse junction sidewalls, and wherein the upper plate includes a plurality of upper anchors at predetermined intervals to which one end of the post-tensioned members is fixed.

2. The fit-together type of precast concrete lining and bridging structural body according to claim 1, wherein each precast concrete deck member includes a plurality of through-holes formed in a body at predetermined intervals.

3. The fit-together type of precast concrete lining and bridging structural body according to claim 1, wherein each precast concrete deck member includes a plurality of bolt insertion grooves formed in a lower surface thereof in a connecting direction at predetermined intervals, and wherein each precast concrete deck member further includes a movable anchor bracket at a lower portion of one end of the precast concrete deck member, wherein the movable anchor bracket includes installation holes into which installation bolts fastened to the bolt insertion grooves are fitted in an upper portion thereof, the movable anchor bracket being movable in the connecting direction of the precast concrete deck member at the lower portion of the end of the precast concrete deck member.

4. The fit-together type of precast concrete lining and bridging structural body according to claim 1, wherein each precast concrete deck member includes a plurality of pin insertion grooves formed in a lower surface thereof in a connecting direction at predetermined intervals, and wherein each precast concrete deck member further includes a movable anchor bracket at a lower portion of one end of the precast concrete deck member, wherein the movable anchor bracket includes a plurality of pins which are inserted into the pin insertion grooves in an upper portion thereof, wherein the movable anchor bracket is movable in the connecting direction of the precast concrete deck member at the lower portion of the end of the precast concrete deck member.

5. The fit-together type of precast concrete lining and bridging structural body according to claim 1, wherein the upper plate includes upper anchors at predetermined intervals to which one end of the post-tensioned members is fixed such that the post-tensioned members are equal in length.

6. The fit-together type of precast concrete lining and bridging structural body according to claim 1, wherein a transverse fixture, to which one end of the post-tensioned members is fixed, is provided between the sidewalls of the precast concrete deck members.

7. The fit-together type of precast concrete lining and bridging structural body according to claim 1, wherein each sidewall is fixed with tubular guide pipes into which the post-tensioned members are inserted, and wherein each post-tensioned member is fixed to opposite ends of each guide pipe.

* * * * *